US010279489B2

(12) United States Patent
Watanabe et al.

(10) Patent No.: US 10,279,489 B2
(45) Date of Patent: May 7, 2019

(54) FULL METAL CUTTER KNIFE

(71) Applicant: Olfa Corporation, Osaka-shi, Osaka (JP)

(72) Inventors: Toshiyuki Watanabe, Kyoto (JP); Minoru Masuda, Osaka (JP); Yosuke Takashima, Suita (JP)

(73) Assignee: OLFA CORPORATION, Osaka (JP)

( * ) Notice: Subject to any disclaimer, the term of this patent is extended or adjusted under 35 U.S.C. 154(b) by 228 days.

(21) Appl. No.: 15/149,626

(22) Filed: May 9, 2016

(65) Prior Publication Data

US 2017/0057102 A1 Mar. 2, 2017

(30) Foreign Application Priority Data

Sep. 2, 2015 (JP) ..... 2015-173102

(51) Int. Cl.
*B26B 1/08* (2006.01)
*B26B 5/00* (2006.01)

(52) U.S. Cl.
CPC ..... *B26B 1/08* (2013.01); *B26B 5/003* (2013.01)

(58) Field of Classification Search
CPC ..... B26B 5/001; B26B 5/003; B26B 1/08
USPC ..... 30/162
See application file for complete search history.

(56) References Cited

U.S. PATENT DOCUMENTS 2,243,030 A * 5/1941 Fischer ..... B26B 1/08 30/162
3,439,419 A * 4/1969 Fleming ..... B26B 5/002 30/162
3,448,518 A * 6/1969 Sklar ..... B26B 5/002 30/162
3,885,308 A 5/1975 Gordin
4,200,977 A * 5/1980 Kageyama ..... B26B 5/002 30/162

(Continued)

FOREIGN PATENT DOCUMENTS

DE 87 04 973 U1 7/1987
EP 2 998 083 A1 2/2016

(Continued)

OTHER PUBLICATIONS

Japanese Office Action issued in counterpart Japanese Application No. 2015-173102 dated Oct. 18, 2016 (three pages).

(Continued)

*Primary Examiner* — Laura M Lee
(74) *Attorney, Agent, or Firm* — Crowell & Moring LLP

(57) ABSTRACT

The present invention provides a cutter knife, which even if made with only the metal parts, smoothness of sliding operation of the blade is not degraded in time, even without lubricating oil nor friction resistant coating, A slider of the cutter knife carries rolling member, which is made rolling contact with the outer surface of the cutter knife. Further, the slider has a protrusion which extends into the cutter knife body and is engaged into a hole formed on the blade. Since an external force applied onto the slider is received by the rolling member, the slider can be operated smoothly. Besides, the height of the protrusion is determined, such that the protrusion does not touch the inner surface of the cutter knife. Thus, the protrusion tip never interfere with the inner surface of the cutter knife, thereby the sliding operation of the slider would not be prevented.

3 Claims, 5 Drawing Sheets

(56) References Cited

U.S. PATENT DOCUMENTS

| | | | | |
|---|---|---|---|---|
| 4,240,202 | A * | 12/1980 | Gilbert | B26B 5/002 30/162 |
| 4,868,985 | A | 9/1989 | Rehm | |
| 5,207,696 | A * | 5/1993 | Matwijcow | A61B 17/3211 30/151 |
| 5,269,063 | A | 12/1993 | Okada | |
| 5,584,123 | A * | 12/1996 | Chi | B23D 51/01 30/125 |
| 5,966,817 | A * | 10/1999 | Lee | B26B 5/001 30/162 |
| 6,226,824 | B1 * | 5/2001 | Hopson | B26B 5/001 29/235 |
| 6,510,612 | B1 * | 1/2003 | Cybulski | B26B 5/002 30/162 |
| 6,578,266 | B2 * | 6/2003 | Chomiak | B26B 5/005 30/2 |
| 7,178,244 | B2 * | 2/2007 | Fossella | B26B 5/00 30/162 |
| 7,647,702 | B2 * | 1/2010 | Polei | B26B 5/001 30/162 |
| 2006/0185172 | A1 * | 8/2006 | Marshall | B26B 1/08 30/162 |
| 2007/0101580 | A1 * | 5/2007 | Fossella | B26B 5/00 30/162 |
| 2010/0024221 | A1 * | 2/2010 | Hernandez | B26B 5/001 30/296.1 |
| 2012/0017441 | A1 * | 1/2012 | Kalajyan | B26B 1/044 30/152 |
| 2016/0031097 | A1 * | 2/2016 | Wu | B26B 5/006 30/162 |

FOREIGN PATENT DOCUMENTS

| | | | |
|---|---|---|---|
| JP | 5-305187 | A | 11/1993 |
| JP | 7-9261 | U | 2/1995 |
| WO | WO 01/78952 | A1 | 10/2001 |

OTHER PUBLICATIONS

Shigeo Suzuki, The Mainichi Graphic, The Mainichi Newspapers, No. 40, Oct. 7, 1979 (one (1) pages).

European Search Report issued in counterpart European Application No. 16168912.0 dated Feb. 3, 2017 (seven pages).

* cited by examiner

FULL METAL CUTTER KNIFE

BACKGROUND OF THE INVENTION

Field of the Invention

The present invention is related to a cutter knife, which can be surely prevented from being entered into other products as a foreign substance.

Description of the Related Art

For example, regarding products of mattress or stuffed toy animal, sometimes a cutter knife used during manufacturing process may remain in the products as a foreign substance. The cutter knife as the foreign substance is to be found by a metal detector and taken out.

For surely being found by a metal detector, the cutter knife may preferably include many metal components. Theoretically, even a common cutter knife, the body of which is made of plastics, could be found by a metal detector, because the blade of which is made of metal. But actually, a cutter knife having less metal components could pass by the metal detector, without being found.

In order to optimally be found by the metal detector, the whole of a cutter knife including its body would be all made with metal parts. The cutter knife made with only metal parts has been already put on the market by the applicant, and was also published in a Japanese magazine of Weekly MAINICHI-GRAPH of Oct. 7, 1979.

However, if the whole of a cutter knife is made with metal parts only, there may be a problem, that is, smoothness of sliding operation of the cutter knife blade could be degraded in time because of friction and the like, particularly in a type of a cutter knife wherein its blade is extended and retracted in a sliding manner. In order to prevent this, lubricating oil or friction resistant coating may be applied, but it could bring another problem, below.

That is, because of the lubricating oil, products of mattress or stuffed toy animal could get dirty, or otherwise, there may be a sanitary problem when the cutter knife is used in the field of foods. Further, applying the friction resistant coating could increase the manufacturing cost.

SUMMARY OF THE INVENTION

An object of the present invention is to provide a cutter knife, having a blade within its body slidably extended from or retracted into the body, in which even if the cutter knife is made with only the metal parts, smoothness of sliding operation of the cutter knife blade is not degraded in time, even without lubricating oil or friction resistant coating.

In order to achieve the objects of the present invention, there is provided a cutter knife comprising:

a cutter knife body, a knife blade, which is slidably held in the cutter knife body, and a slider, via which the knife blade is operated to extend from or retract into the cutter knife body, wherein at least one of the knife blade and the slider is supported, at a position where the knife blade and/or the slider is made contact with the cutter knife body, by a rolling member which reduces frictional interference.

Note that, in the present invention, the word "rolling member" means anything, with which frictional interference can be lowered taking advantage of its rolling action, for example, a column, a cylinder, a sphere or the like.

With the cutter knife of the present invention, constructed as above, regarding the knife blade and the slider, which slide relatively to the cutter knife body, at least one of which (preferably both) is supported by a rolling member which reduces frictional interference, at a position where the knife blade and/or the slider is made contact with the cutter knife body.

Thus, even if the whole of the cutter knife is made with metal parts only, without lubricating oil nor friction resistant coating, the smooth sliding operation of the slider can be realized for long time in use.

In other words, by making the cutter knife with metal parts only, the cutter knife would be surely sensed by a metal detector. Furthermore, without lubricating oil nor friction resistant coating, the smooth sliding operation of the slider can be realized for long time in use.

Thus, thanks to the present invention, a cutter knife, of which the smooth operation is not degraded for long time in use, can be made with metal parts only, and thus, such the cutter knife can be surely sensed by a metal detector.

But note that, in the present invention, it is not necessary needed to make the cutter knife with 100% only metal parts, and partially other materials could be used in some portion of the cutter knife to some extent, as long as actually no problem is brought.

BRIEF DESCRIPTION OF THE DRAWINGS

These and other objects and features of the present invention will become apparent from the following description taken in conjunction with the preferred embodiments thereof with reference to the accompanying drawings.

DETAILED DESCRIPTION OF THE PREFERRED EMBODIMENT

Figure 1A:
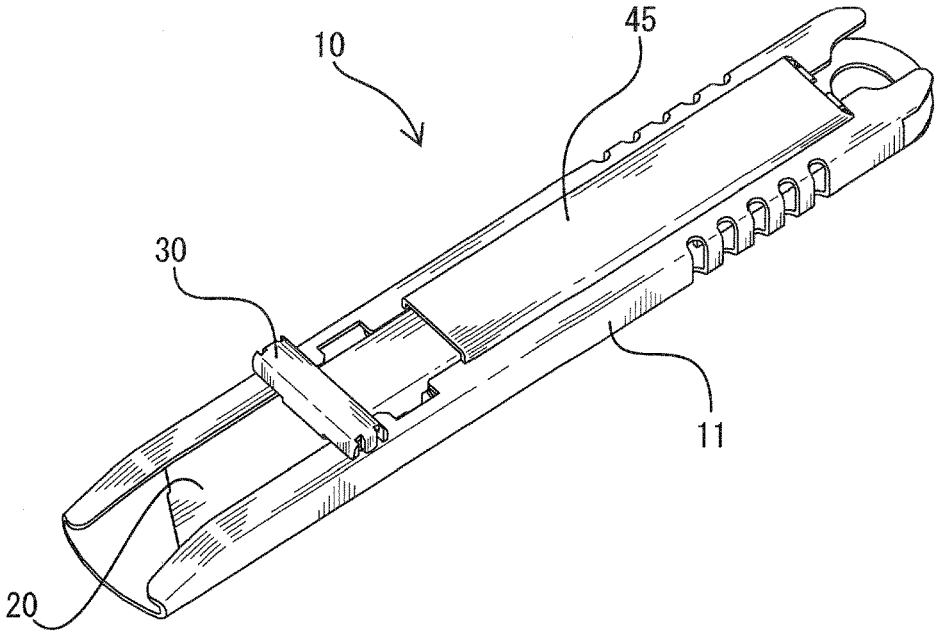
FIGS. 1A and 1B are respectively a perspective view of a cutter knife according to the first embodiment of the present invention.

Before the description of the embodiments proceed, it is to be noted that like or corresponding parts are designed by like reference numerals throughout the accompanying drawings.

Referring to FIGS. 1A to 4, a description is made below on a cutter knife 10, according to the first embodiment of the present invention.

First Embodiment—General Construction of the Cutter Knife 10

Figure 1B:
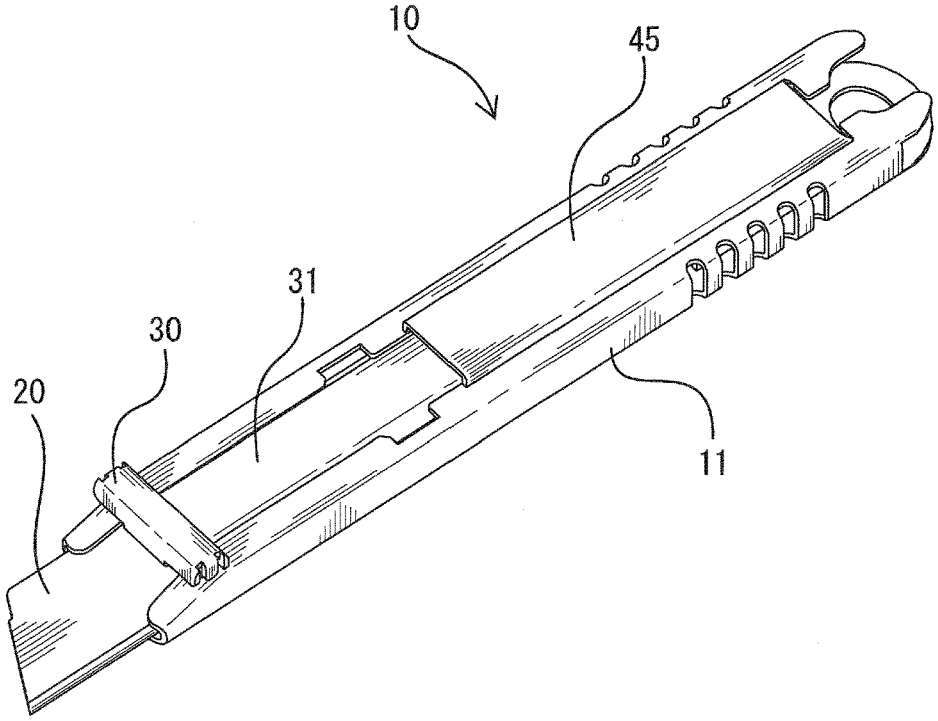

FIGS. 1A and 1B shows the cutter knife 10. In FIG. 1A, the blade 20 is retracted into the cutter knife body 11, and in FIG. 1B, the blade 20 is extended from the cutter knife body 11.

A user operates the slider 30, which is mounted outside of the cutter knife body, to extend the blade 20 from the cutter knife body 11 and to retract the blade 20 into the body 11. The slider 30 is being urged in the direction of retracting the blade 20, by the spring 40 mounted inside the cutter knife body 11 (see FIG. 2), such that when the user releases his/her finger from the slider 30, the blade 20 is always to be retracted into the cutter knife body 11 (see FIG. 1A).

Figure 2:
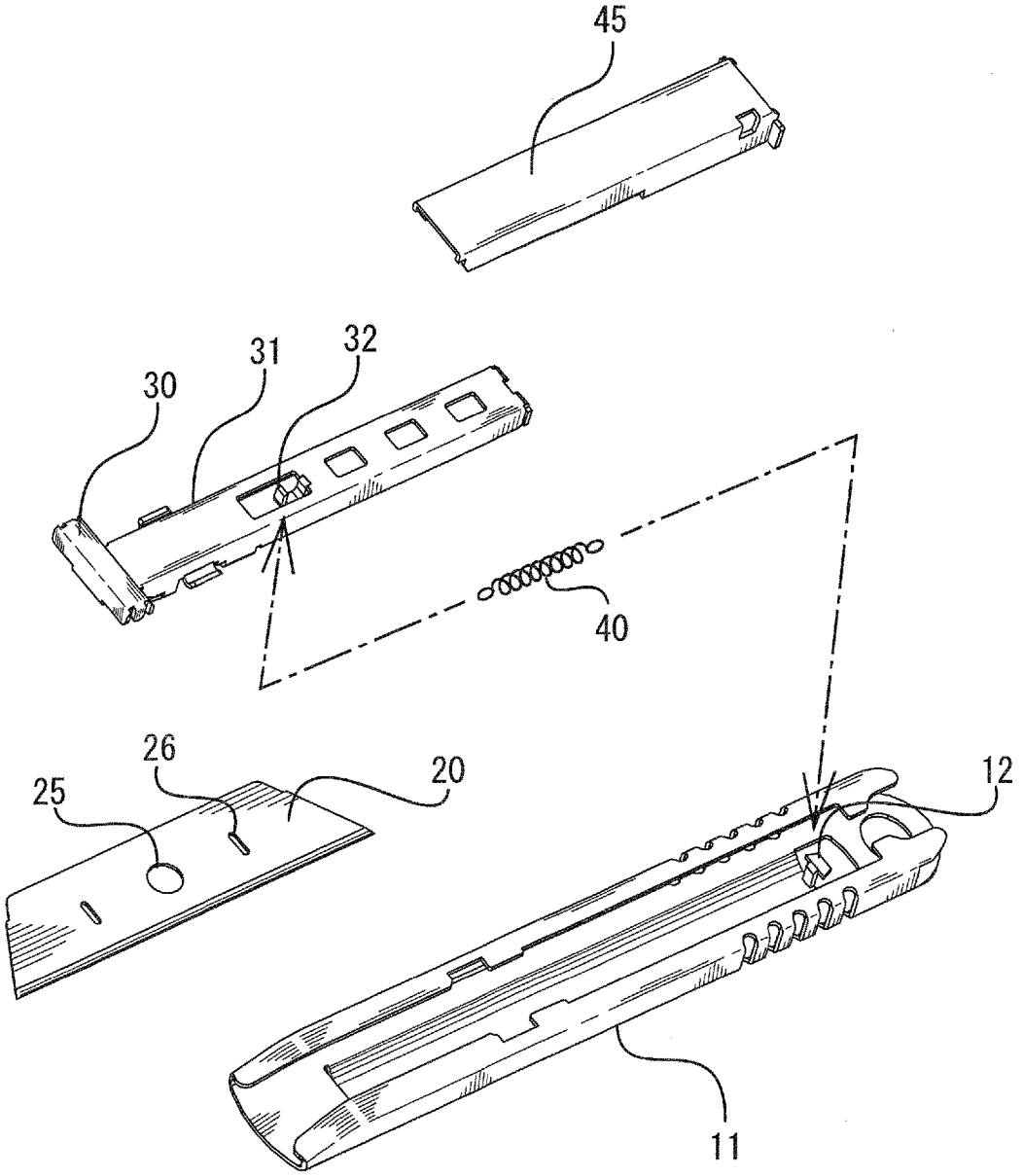
FIG. 2 is an exploded view of the cutter knife in FIGS. 1A and 1B.

FIG. 2 is an exploded view of the cutter knife 10. The cutter knife body 11 is a sleeve-like, within which the blade 20 can slide in the longitudinal direction. The slider 30 is mounted outside the cutter knife body 11, such that the user can operate the slider 30 with his/her finger. In the shown embodiment, the slider 30 is integrally formed with an elongated sliding member 31 at its forward end, which is mounted inside the cutter knife body 11.

The cover member 45 is to be attached to the cutter knife body 11, such that the cover member 45 extends over the sliding member 31. Thanks to this cover member 45, the smooth sliding operation of the sliding member 31 is ensured, even when the cutter knife 10 is grasped in hand.

The sliding member 31 and the cutter knife body 11 are connected with each other by the spring 40. With the spring force of the spring 40, the slider 30 is urged in the direction of retracting the blade 20. That is, as shown in FIG. 2, one end of the spring 40 is retained at the hook 12 of the cutter knife body 11, and the other end of the spring 40 is retained at the hook 32 of the sliding member 31.

First Embodiment—Connecting Manner Between the Slider 30 and the Blade 20

Figure 3:
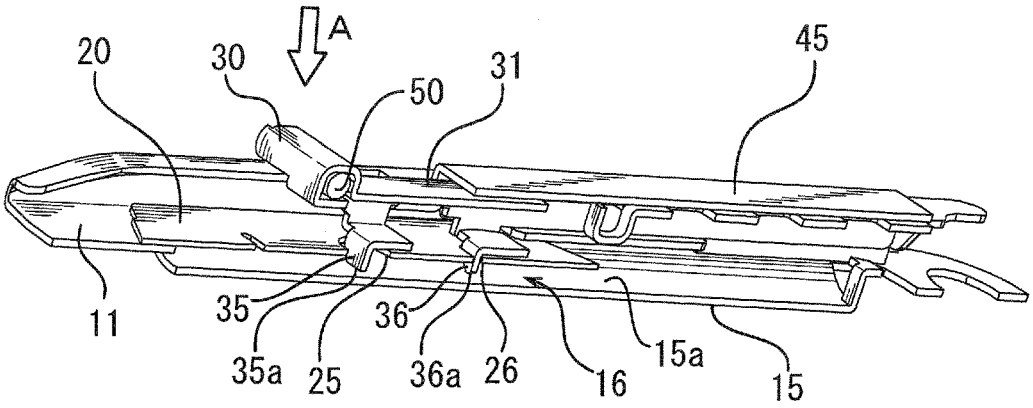
FIG. 3 is a sectional view of the cutter knife in FIGS. 1A and 1B in its longitudinal direction.

As best shown in FIG. 3 of a sectional view in longitudinal direction, the slider 30 has protrusions 35, 36 on the sliding member 31, extending in the cutter knife body 11. These protrusions 35, 36 are engaged into the holes 25, 26 formed on the blade 20, such that the slider 30 and the blade 20 can slide together.

The height of the protrusions 35, 36 is determined, such that their tips 35*a*, 36*a* do not touch with the inner surface 15*a* of the cutter knife body 11 in an assembled up condition of the cutter knife 10. Thanks to such the construction, when the slider 30 slides along with the cutter knife body 11, the protrusion tips 35, 36 are surely prevented from interfering with the inner surface 15*a* of the cutter knife body 11, and thus realizing the smooth sliding operation.

Note that although in the shown embodiment two protrusions 35, 36 are made engaged into the holes formed on the blade, the number of the protrusions can be conveniently selected.

First Embodiment—Rolling Manner 50 which the Slider 30 Carries

Figure 4:
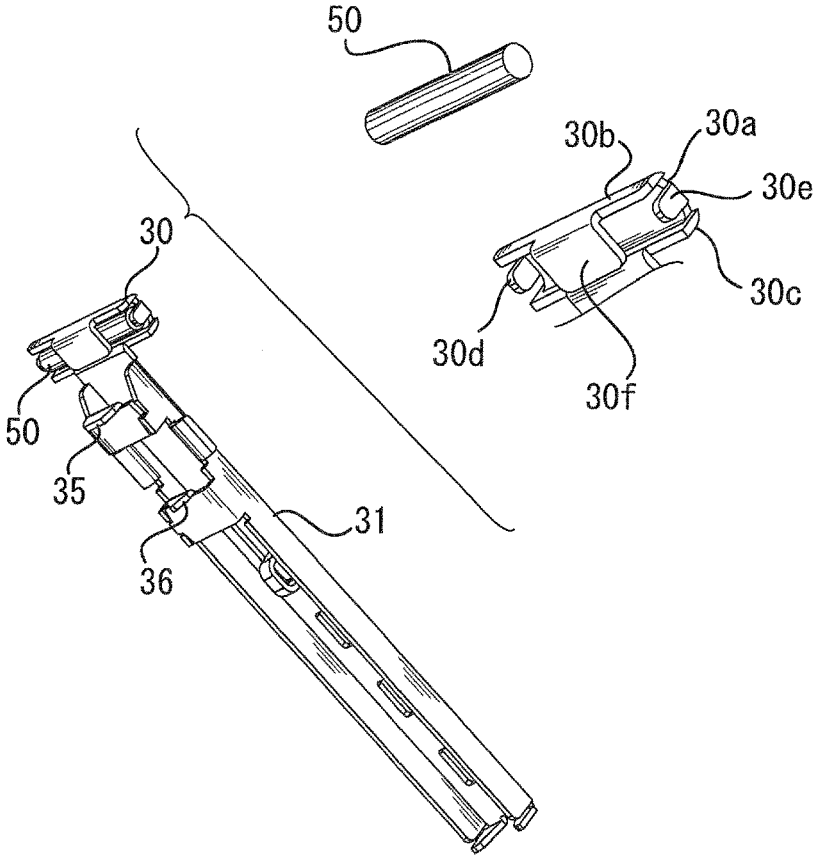
FIG. 4 is a bottom perspective view, showing the back side of the slider 30 and the sliding member 31 which are components of the cutter knife in FIGS. 1A and 1B.

FIG. 4 is a bottom perspective view, showing the back side of the slider 30 and the sliding member 31. In FIG. 4, in order to better show the configuration of the slider 30 and the column 50 which is rotatably held thereto, partially enlarged views are also shown therein.

In the shown embodiment, the slider 30 is a member having a cross sectional view of U-shape, which comprises the top wall 30*a* and opposed two side walls 30*b*, 30*c*, and in which the space of U-shape, a column (rolling member) 50 is carried so as to freely roll. In order prevent unwillingly fall off of the column 50 from the slider 30 while allowing the column 50 to freely roll, there are provided stop walls 30*d*, 30*e* at the both ends of the top wall 30*a*, and the receiving wall 30*f* at the lower end of the side wall 30*b*.

First Embodiment—Mechanism for Realizing the Smooth Slide Operation of the Slider 30

(I)

Generally speaking, when operating the slider 30 with a finger, gripping the cutter knife 10 in hand, the external force applied from the finger to the slider 30 will act in the direction of pushing the slider 30 onto the outer wall of the cutter knife body 11 (arrow "A", FIG. 3). In the cutter knife 10 of the present invention, such the external force is received by the column 50 which is contacting with the outer wall of the cutter knife body 11, and which is carried so as to freely roll. Thus, the column 50 will roll on the outer wall of the cutter knife body 11, and thereby the slider 30 can be smoothly operated to slide.

(II)

The heights of the protrusions 35, 36 which connect the slider 30 and the blade 20 are designed, such that their tips 35*a*, 36*a* do not reach the inner surface 15*a* of the cutter knife body 11. Thus, even if an external force is applied onto the slider 30 in the direction of the arrow "A" in FIG. 3, the protrusions 35, 36 do not touch the inner surface 15*a*, and thus the smooth sliding operation of the slider 30 is not to be prevented.

(III)

Further, since such the protrusions 35, 36 are engaged into the holes 25, 26 formed on the blade 20 to connect the slider 30 and the blade 20, the external force "A" (FIG. 3) applied on the slider 30 is never propagated to the blade 20. Therefore, the blade 20 is never pressed onto the inner surface 15*a* of the cutter knife body 11 (and the inner surface therearound) to generate friction.

Thanks to the above factors (I)-(III) together, in the present invention, even if the whole of the cutter knife is made with metal parts only, the smooth sliding operation of the slider 30 (that is, smooth extending out and retracted into) can be realized for long time in use. For that, lubricating oil or friction resistant coating is not needed.

Thus, thanks to the present invention, a cutter knife, of which the smooth operation is not degraded for long time in use, can be made with metal parts only, and thus, such the cutter knife can be surely sensed by a metal detector. Note that it is not necessary needed to make a cutter knife with 100% only metal parts, and partially other materials could be used.

Variant of the First Embodiment (I)

In the shown embodiment, a column is employed as the rolling member 50 and its rolling action is taken advantage of. But, as long as the same effect is obtained, a cylindrical member, a spherical member and the like can be used. Depending on the specific configuration of the rolling member, the configuration of the slider 30 would be changed, such that the rolling member is carried so as to freely roll while unwilling fall off of the slider 30 is prevented.

(II)

in the shown embodiment, the wall 15, which is opposed to the wall on which the slider 30 is mounted, is raised outwardly, and due to such the raise the inner surface 15*a* of the cutter knife body 11 is depressed outwardly. The protrusion tips 35*a*, 36*a* terminate in the space 16 formed by the depression, and thanks to this, the protrusion tips 35*a*, 36*a* are prevented from interfering with (touching) the inner surface 15*a* of the cutter knife body 11. Simultaneously, thanks to the moderate raise of the wall 15, ease of grasping the cutter knife and of handling the same can be improved.

Note that the raise of the wall 15 is not necessary needed, and for example, the wall 15 could be made flat and the heights of the protrusions 35, 36 could be adjusted so as not to touch the inner surface of the wall 15.

Second Embodiment—the Rolling Member is Located at the Protrusion Tip

Figure 5:
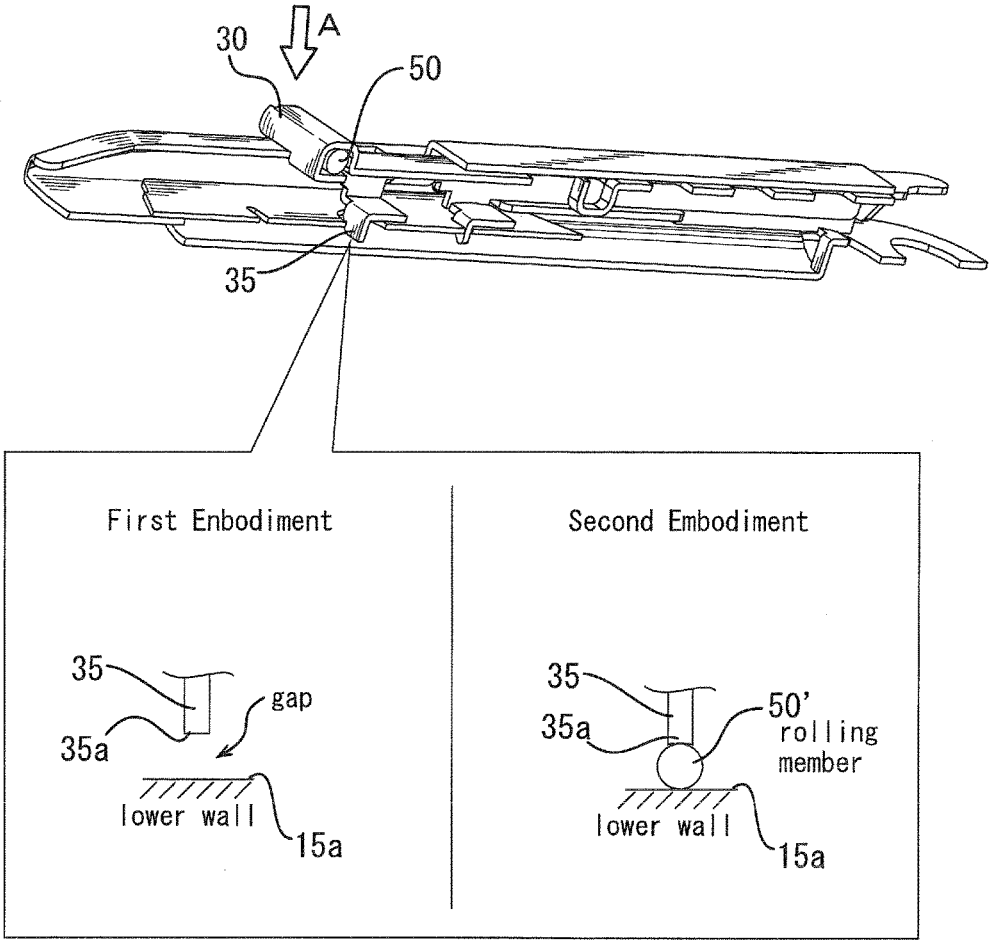
FIG. 5 is an explanatory view, showing the second embodiment of the cutter knife, in comparison with the first embodiment.

FIG. 5 shows the cutter knife according to the second embodiment of the present invention, in comparison with the first embodiment. Only the difference of the second embodiment to the first embodiment is the location of the rolling member, and thus the difference is only explained. FIG. 5 is one corresponding to FIG. 3, and shows the region around the tip of the protrusion 35, enlarged.

In the first embodiment (FIGS. 1A-4), the height of the protrusion 35 is determined, such that the protrusion tip 35*a* does not reach the inner surface 15*a* of the cutter knife body 11, and thanks to this, interference between the protrusion tip 35*a* and the inner surface 15*a* was prevented.

On the contrary, in the second embodiment, the rolling member 50' is located at the tip of the protrusion 35, thereby preventing interference between the protrusion tip 35*a* and the inner surface 15*a*. Although the location of the rolling member 50' is schematically shown in FIG. 5, actually the rolling member 50' is one, for example a column, a cylinder, a sphere, or the like, which is held at the protrusion tip 35*a* so as to freely roll. Such the rolling member 50' contact with and rolls on the inner surface 15*a*, thereby ensuring the smooth sliding operation of the slider 30.

Variant of the Second Embodiment (I)

In the second embodiment shown in FIG. 5, only one protrusion 35 is provided with the rolling member 50' at its tip. But, both of the protrusions 35, 36 (or further additional protrusions) could be provided with the rolling member 50, likewise.

(II)

In the second embodiment, the force acting in the direction of the arrow "A" onto the slider 30 is received by the rolling member 50, and thus, the rolling member 50 carried by the slider 30 could be omitted. But, in such the case, there may be preferably provided a suitable gap, between the slider 30 and the outer surface of the cutter knife body 11.

Third Embodiment—the Blade-Support Rolling Member is Provided

Figure 6:
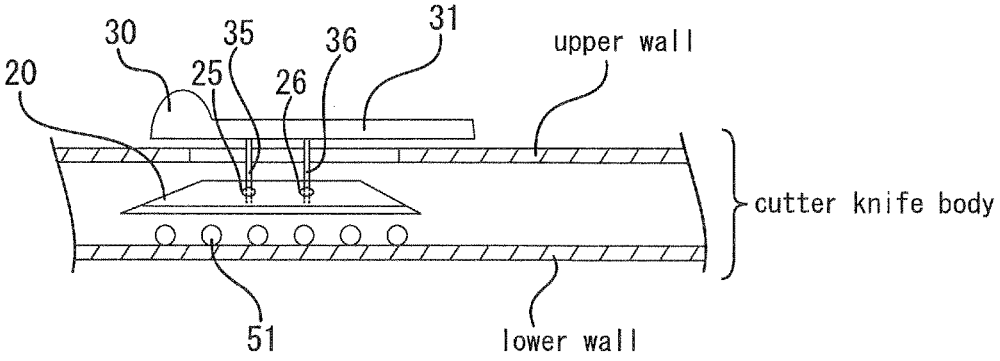
FIG. 6 is a view showing the third embodiment of the cutter knife schematically.

FIG. 6 shows the third embodiment of the present invention, schematically. In FIG. 6, only the upper wall and the lower wall of the sleeve-like cutter knife body are shown with the hatching of cross-section. Further, for the sake of better understanding, only the blade 20 is drawn in somewhat perspectively.

On the upper wall, the slider 30 is slidably mounted, and the protrusions 35, 36 extend downwardly from the sliding member 31, which slide together with the slider 30. These protrusions 35, 36 are made engaged into the holes 25, 26 formed on the blade 20.

The above basic configuration in the third embodiment is the same as those in the first and second embodiments, which were already explained.

The third embodiment is different from the first and second embodiments in that rolling members 51 (blade-support rolling member) are provided between the lower surface of the blade 20 and the lower wall. The blade-support rolling members 51 are to support the blade surface far from the slider 30 with rolling contact on it, thereby securing the smooth sliding operation of the blade 20.

As is explained above, thanks to the construction of the first or the second embodiment, the blade 20 is prevented from being pressed onto the bottom wall of the cutter knife by the external force acting on the slider 30. But, there may be a possibility that some other unwilling external force via another route would act on the blade 20. Even in such the case, thanks to the existence of the blade-support rolling member 51, frictional interference between the blade 20 and the bottom wall of the cutter knife could be prevented, thereby securing the smooth sliding operation.

The construction shown in FIG. 6 may be preferably provided additionally on the construction of the first or the second embodiment. But, even if the construction shown in FIG. 6 is provided solo, the smooth sliding operation of the blade 20 could be secured.

As the blade-support rolling member 51, a column, a cylinder, a sphere or the like suitable could be employed, as long as with which the friction can be lowered taking advantage of rolling contact. Such the blade-support rolling member 51 would be mounted in a suitable manner and at a suitable location. Further, the blade-support rolling members 51 are preferably provided in plural along with the sliding direction of the blade 20, as shown in FIG. 6. But, even if only one blade-support rolling member 51 is provided, some extent of the same effect could be obtained.

Fourth Embodiment—the Sliding-Member-Support Rolling Member is Provided

Figure 7A:
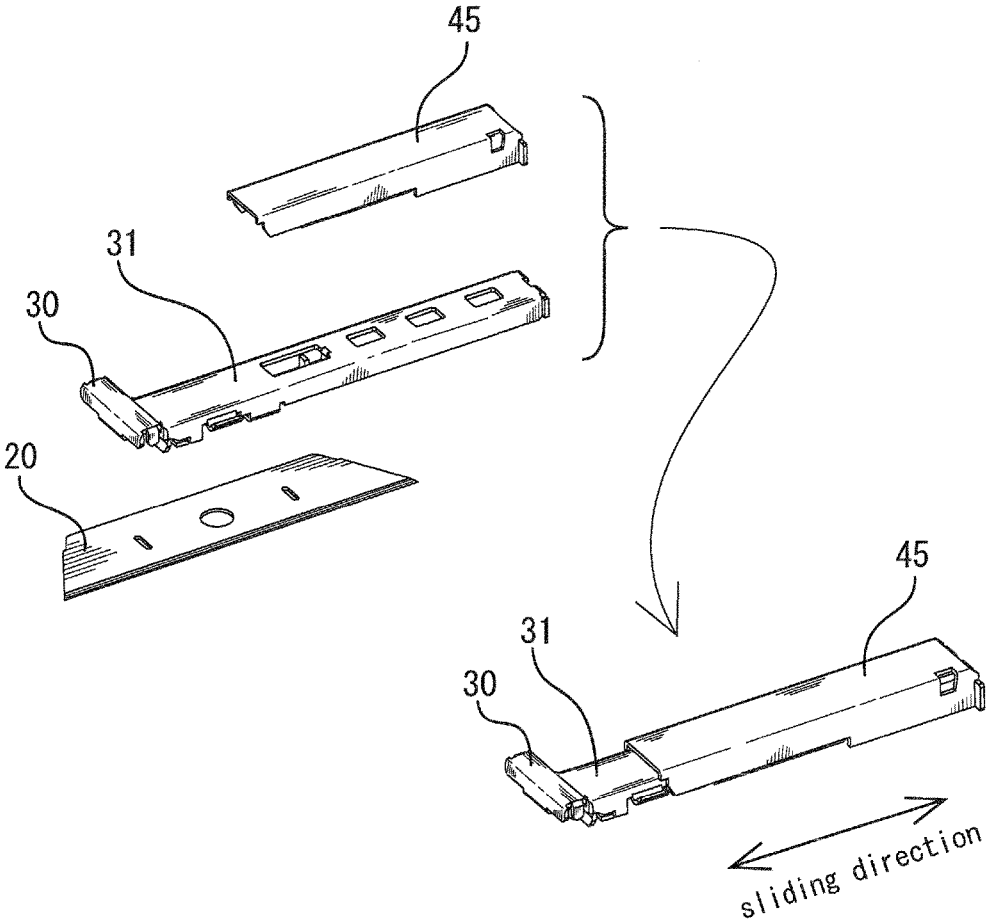
FIGS. 7A and 7B are respectively a view showing the forth embodiment of the cutter knife schematically.
Figure 7B:
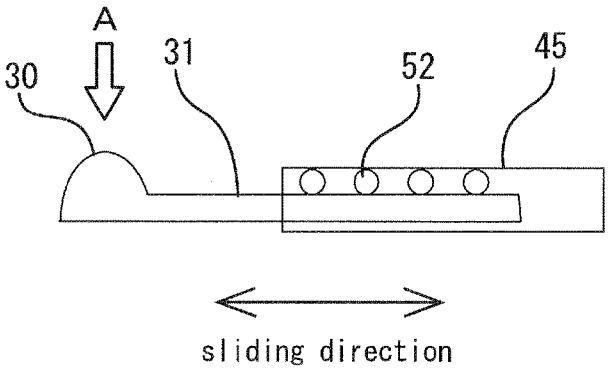

FIGS. 7A and 7B show the fourth embodiment of the present invention, schematically. In FIGS. 7A and 7B, only the blade 20, the slider 30, the sliding member 31, and the cover member 45 are shown, taken out of FIG. 1. In this embodiment, the sliding member 31, on which the slider 30 is fixed, is held in the cover member 45, and thus is able to slide, being guided by the inner surface of the cover member 45.

Here, in between the sliding member 31 and the cover member 45, a plurality of rolling members 52 (sliding-member-support rolling member) are provided along with the longitudinal direction of the sliding member 31.

The sliding member 31 is supported by the plurality of sliding-member-support rolling members 52, which are provided along with the longitudinal direction of the sliding member 31. In other words, the sliding member is supported by rolling members at discrete several points along with the longitudinal direction of the sliding member 31. Therefore, even if an external force acting in the direction of the arrow "A" is applied onto the slider 30 which is located at the end of the sliding member 31, the sliding member 30 would scarcely be inclined to its sliding direction (if the inclination of the sliding member 31 occurs, the blade 20 existing below the sliding member 31 may be pressed onto the bottom wall of the cutter knife body, and thus not preferable).

In the embodiment shown in FIGS. 7A and 7B, a plurality of the sliding-member-support rolling members 52 are provided between the sliding member 31 and the cover member 45. Other than such the construction, some construction would bring the same effect, for example where an elongated sliding member 31 is employed, and the sliding member is guided by some surface extending along its longitudinal direction (sliding direction), and a plurality the sliding-member-support rolling members 52 are provided there.

As the sliding-member-support rolling member 52, a column, a cylinder, a sphere or the like suitable could be employed, as long as with which the friction can be lowered taking advantage of rolling contact. Such the sliding-member-support rolling member 52 would be mounted in a suitable manner and at a suitable location.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A cutter knife comprising:

a cutter knife body, a knife blade, which is slidably held in the cutter knife body, and a slider that slides along the cutter knife body to operate the knife blade to extend or retract into the cutter knife body, wherein the slider carries a rolling member, which rolls along and in rolling contact with an outer surface of the cutter knife body when the slider sliders along the cutter knife body while bearing an external force applied from a finger of a user operating the slider, and has a protrusion which extends into the cutter knife body and is engaged into a hole formed on the knife blade, and a height of the protrusion is determined, such that a tip of the protrusion does not touch with an inner surface of the cutter knife body when the slider slides along the cutter knife body.

2. The cutter knife according to claim 1, wherein:

a wall of the cutter knife body, which is opposed to another wall on which the slider is mounted, forms a depression, and the tip of the protrusion terminates in a space formed by the depression.

3. The cutter knife according to claim 1, wherein the cutter knife is made with metal parts only.

* * * * *